United States Patent [19]

Eschard

[11] Patent Number: 4,806,827

[45] **Date of Patent: * Feb. 21, 1989**

[54] MULTIPLIER ELEMENT OF THE APERTURE PLATE TYPE, AND METHOD OF MANUFACTURE

[75] Inventor: Gilbert Eschard, Brive, France

[73] Assignee: U.S. Philips Corporation, New York, N.Y.

[ * ] Notice: The portion of the term of this patent subsequent to Mar. 10, 2004 has been disclaimed.

[21] Appl. No.: 914,848

[22] Filed: Oct. 3, 1986

[30] Foreign Application Priority Data

Dec. 31, 1985 [FR] France ..... 85 19482

[51] Int. Cl.[4] ..... H01J 43/00

[52] U.S. Cl. ..... 313/533; 313/103 R; 313/103 CM; 313/105 R; 313/105 CM

[58] Field of Search ..... 313/534, 535, 536, 540, 313/103 R, 103 CM, 104, 105 R, 105 CM, 533

[56] References Cited

U.S. PATENT DOCUMENTS

| | | | |
|---|---|---|---|
| 2,872,721 | 2/1959 | McGee | 313/535 |
| 3,374,380 | 3/1968 | Goodrich | 313/105 CM |
| 3,513,345 | 5/1970 | Feaster | 313/533 |
| 3,564,323 | 2/1971 | Maeda | 313/103 CM |
| 3,612,946 | 10/1971 | Toyoda | 313/103 CM |
| 3,849,692 | 11/1974 | Beasley et al. | 313/105 CM |
| 3,873,867 | 3/1975 | Girvin | 313/534 |
| 3,879,626 | 4/1975 | Washington et al. | 313/534 |
| 3,939,375 | 2/1976 | Schagen et al. | 313/105 R |
| 4,023,063 | 5/1977 | King et al. | 313/534 |
| 4,025,813 | 5/1977 | Eschard et al. | 313/534 |
| 4,031,423 | 6/1977 | Siegmund | 313/105 CM |
| 4,041,343 | 8/1977 | Orthuber | 313/105 R |
| 4,071,474 | 1/1978 | Kishimoto | 313/105 CM |
| 4,482,836 | 11/1984 | Washington et al. | 313/105 CM |
| 4,649,314 | 3/1987 | Eschard | 313/103 CM |

FOREIGN PATENT DOCUMENTS

| | | | |
|---|---|---|---|
| 1321022 | 6/1973 | United Kingdom | 313/103 CM |

OTHER PUBLICATIONS

Tannas, Jr., "Flat Panel Displays and CRTs", Van Nostrand Reinhold Company, 1985, pp. 213-236.

*Primary Examiner*—Leo H. Boudreau
*Assistant Examiner*—Mark R. Powell
*Attorney, Agent, or Firm*—F. Brice Faller

[57] ABSTRACT

Electron multiplier element for secondary emission, consisting of a first metal plate (11) which has at least one multiplier hole (12) having one input aperture (13) and one output aperture (14), and a second metal plate (16) in parallel with the first plate (11) which has at least one auxiliary hole (17) disposed opposite the output aperture (14) of the multiplier hole (12). The second plate (16) being brought to an electric potential (V1) which is higher than the electric potential (V0) of the first plate. The apertures (13, 14) are such that the projection (18) of the output aperture (14) of the multiplier hole (12) in a plane which is parallel to the first metal plate (11) is at least partially located outside the corresponding projection (19) of the input aperture (13).

9 Claims, 6 Drawing Sheets

MULTIPLIER ELEMENT OF THE APERTURE PLATE TYPE, AND METHOD OF MANUFACTURE

BACKGROUND OF THE INVENTION

The invention relates to an electron multiplier element for secondary emission having a first metal plate which has at least one multiplier hole, having one input aperture and one output aperture and whose wall has emissive power. A second metal plate in parallel with the first plate has at least one auxiliary hole disposed opposite the output aperture of the multiplier hole. The second plate is electrically insulated from the first and brought to an electric potential which is higher than electric potential of the first plate.

The invention also relates to an electron multiplier comprising N multiplier elements as described , application of one electron multiplier in a photomultiplier tube and a method of manufacturing the electon multiplier element.

A particular advantageous use of the invention is in the field of photomultiplier tubes.

A multiplier element of the type described in the opening paragraph is known from French Patent Application No. 2,549,288 to which U.S. Pat. No. 4,649,314 corresponds. This application describes a multiplier element whose multiplier holes are either symmetrical, that is to say, the input and output apertures are coaxial, or asymmetrical, that is to say, the input and output apertures are shifted with respect to one another, whilst the output aperture is located opposite the input aperture. This electron multiplier element structure has the drawback of a limited collection efficiency because numerous incident electrons can traverse the multiplier element without undergoing multiplication on the walls of the multiplier holes by passing directly through the input and output apertures. On the other hand this loss of collection efficiency reoccurs at each stage of a multiplier comprising N multiplier elements of the known type and is thus translated into a loss of gain, a linearity error and a longer response time, for example, when this multiplier is incorporated in a photomultiplier tube.

According to the invention the input apertures are longer than respective output apertures, and a perpendicular projection of the output aperture on to a plane parallel to the plate lies at least partly and preferably entirely outside the corresponding projection of the input aperture.

Thus, the majority of incident electrons reaching the electron multiplier element, with the exception of the few electrons occurring at an angle of incidence which is too large, encounter the wall of the multiplier hole where they are subjected to a multiplication. Tests carried out on the multiplier holes having entirely shifted apertures have shown that the collection efficiency of such a multiplier element is substatially improved. Despite the relatively large dimensions of the multiplier hole, multiplied electrons do not return to the wall of the hole where they would be lost. This experimental fact sustains the idea of a possibility of electrons rebounding without any loss on the wall of the multiplier hole.

In a general embodiment of the multiplier element the first metal plate has a plurality of multiplier holes arranged in a regular plane network which may be square-shaped or hexagonal, whilst the input and output apertures are circular, square-shaped or hexagonal.

In an electron multiplier comprising N multiplier elements according to the invention the second metal plate of the (i)th multiplier element is brought to an electric potential which is identical to the electic potential of the first metal plate of the (i+1)st multiplier element.

In this manner a better collection of electrons is ensured between a multiplier element and the next element when these elements are relatively remote from each other. With an improved collection efficiency the electron multiplier also provides the possibility of forming an image. Two geometry types may be envisaged, one in which the N multiplier elements are arranged in a parallel configuration with respect to one another and in another advantageous geometry the N multiplier elements are arranged in a head-to-tail configuration with respect to one another which at a each multiplication permits the electron beam to retrace.

The multiplier can be used advantageously in a photomultiplier tube comprising a photocathode and n adjacent anodes. The multiplier is placed in the proximity of the photocathode and is divided into n secondary multipliers by partitions which are impervious to electrons and are located substantially opposite separation zones of two adjacent anodes in such a manner that n secondary photomultiplier tubes are obtained in the same photomultiplier tube.

Finally a method of manufacturing a first metal plate of an electron multiplier element according to the invention is characterized in that the two faces of the same metal plate are simultaneously etched with the aid of a pair of masks whose successive windows increase in size and are shifted with respect to one another, the windows of the last pair of masks reproducing the shapes of the input aperture and the output aperture, respectively, of the multiplier hole.

DETAILED DESCRIPTION OF THE PREFERRED EMBODIMENTS

Figure 1A:
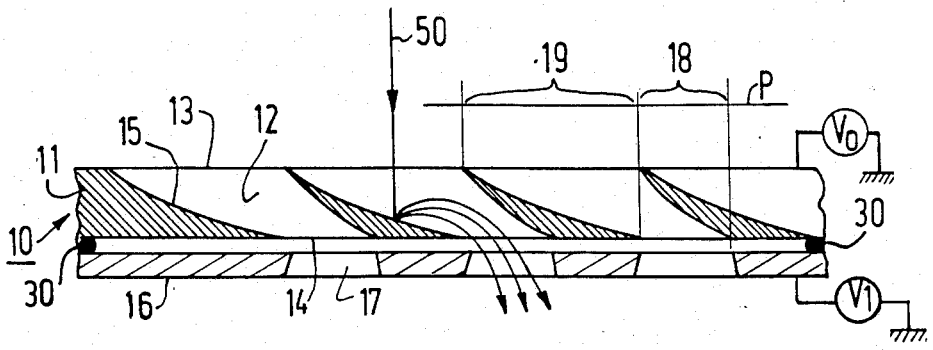
FIG. 1*a* is a cross-section of a first embodiment of the electron multiplier element.
Figure 1B:
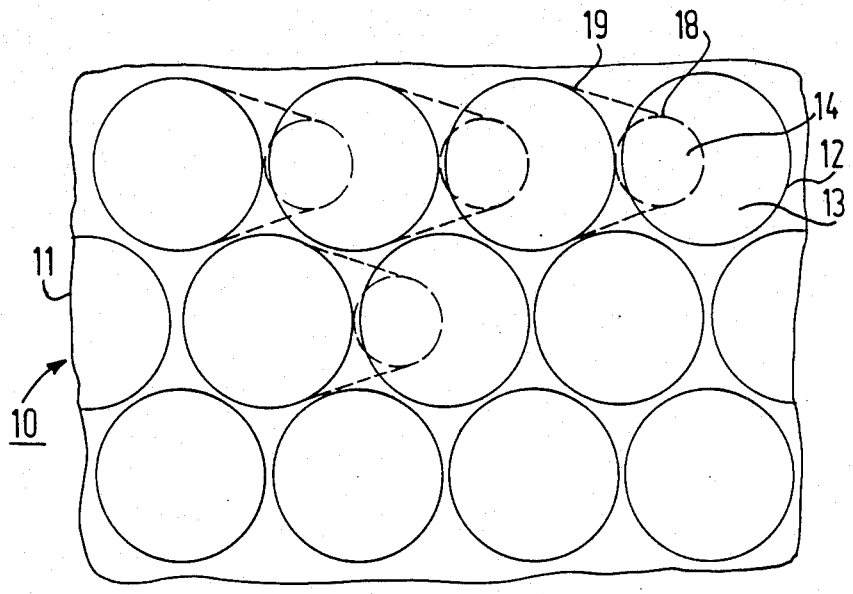
FIG. 1*b* is a plan view of the first embodiment.
Figure 2A:
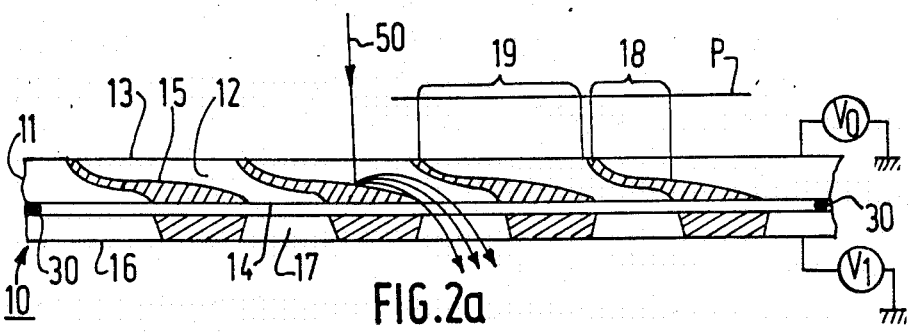
FIG. 2 is a cross-section of a second embodiment of the electron multiplier element.
FIG. 2*b* is a plan view of the second embodiment.
Figure 2B:
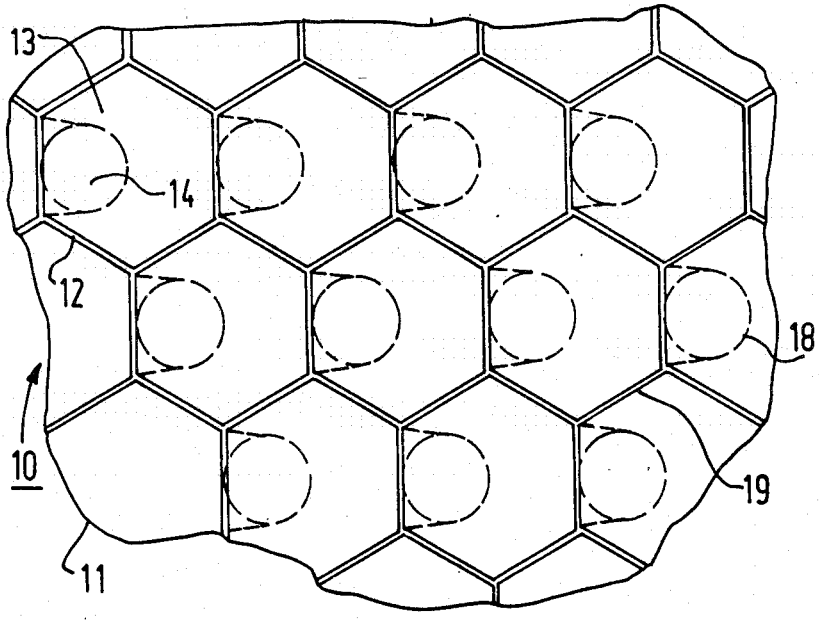
Figure 3A:
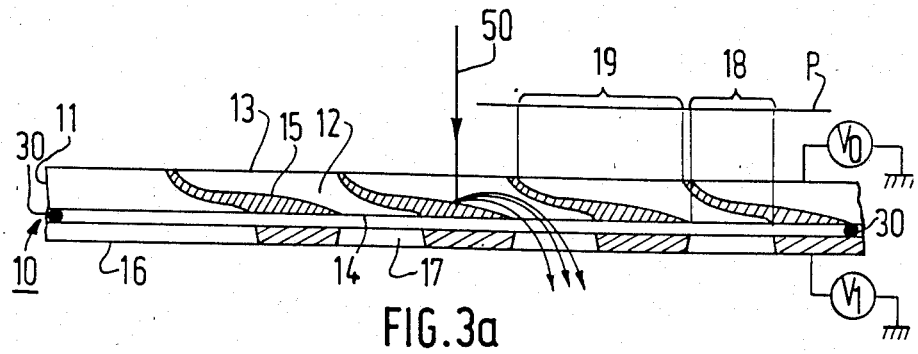
FIG. 3*a* is a cross-section of a third embodiment of the electron multiplier element.
Figure 3B:
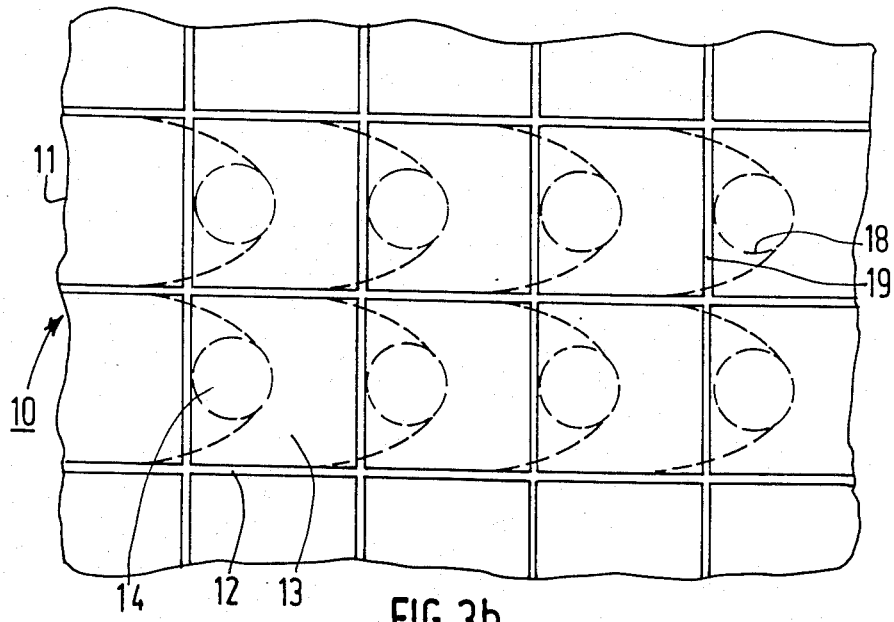
FIG. 3*b* is a plan view of the third embodiment.

FIGS. 1, 2 and 3 show in a cross-section (FIGS. 1*a*, 2*a*, 3*a*) and in a plan view (FIGS. 1*b*, 2*b*, 3b) an electron multiplier element 10 for secondary emission consisting of a first metal plate 11 having holes 12, referred to as multiplier holes, having one input aperture 13 and one output aperture 14. The interior partition 15 of the multiplier holes 12 has emissive power. For this purpose the first metal plate 11 is manufactured from a material which is susceptible to secondary emission such as an alloy of copper-beryllium which is heated to cause migration of beryllium and oxidation. It may alternatively be made of a material which is less costly such as mild steel coated with a secondary emission material: a coating of an alloy of oxidized copper-beryllium or a coating of manganese oxide.

A second metal plate 16 in parallel with the first plate has holes 17, referred to as auxiliary holes, arranged opposite the output apertures 14 of the multiplier holes 12. This second metal plate 16 is electrically insulated from the first plate 11, and the electrical insulation of the two plates 11 and 16 can be realized, for example, with the aid of small glass balls 30 of 100 to 200 μm in diameter sealed to the periphery of these plates. The second metal plate 16 is bought to an electric potential V1 which is higher than the electric potential V0 of the first plate 11, the second plate 16 thus functioning as an acceleration electrode.

As is shown in FIGS. 1*a*, 1*b*, 2*a*, 2*b* and 3*a*, 3*b* the right-hand projection of the output aperture 14 of the multiplier hole 12 in a plane P parallel to the first metal plate 11 is at least partly, in this case entirely, located outside the corresponding projection 19 of the input aperture 13. This configuration gives the incident electrons 50, whose angle of incidence is not very large, a maximum capture surface on the multiplying wall 15. In other words, the majority of electrons penetrating the multiplier hole 12 via the input aperture 13 cannot directly leave the output aperture 14 but give rise to a secondary emission, thus contributing to a substantial improvement of the collection efficiency of the multiplier element 10, as has been observd experimentally by the Applicant. This leads to the belief that the electrons which impinge on the multiplying wall 15 relatively far away from the output aperture 14 and which do not directly leave after multiplication can rebound without any loss on the wall before they leave the output aperture.

As can be seen in FIGS. 1*b*, 2*b* and 3*b*, the first metal plate 11 has a plurality of multiplier holes 12 arranged in accordance with a regular plane network. In conformity with FIG. 1b this regular plane network is a hexagonal network and the said input and output apertures (13,14) are circular. FIGS. 2*b* and 3*b* show two configurations which allow the useful multiplication surface of the first plate 11 to be increased. According to FIG. 2*b* the regular plane network of multiplier holes (12) is a hexagonal network, whilst the input apertures 13 are hexagonal and the output apertures 14 are circular, and according to FIG. 3*b* the regular plane network of multiplier holes 12 is a square-shaped network whilst the input apertures 13 are square-shaped and the output apertures 14 are circular.

Figure 4:
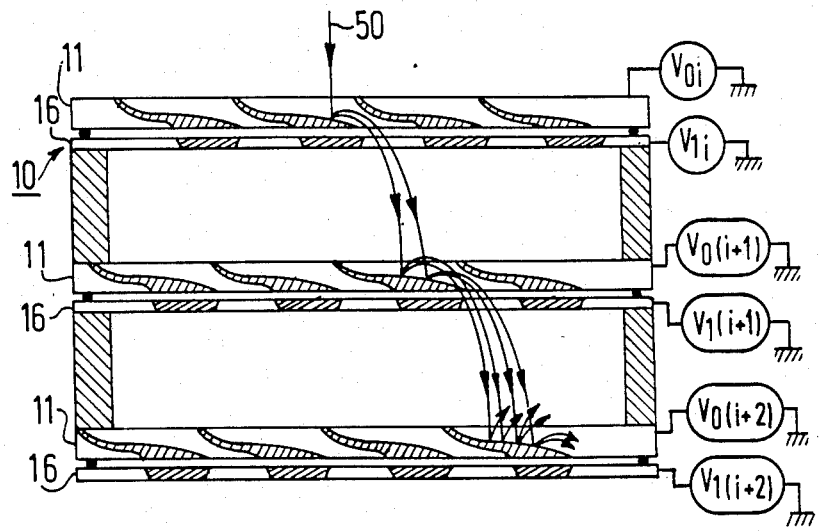
FIG. 4 is a cross-sectional view of a first election multiplier.
Figure 5:
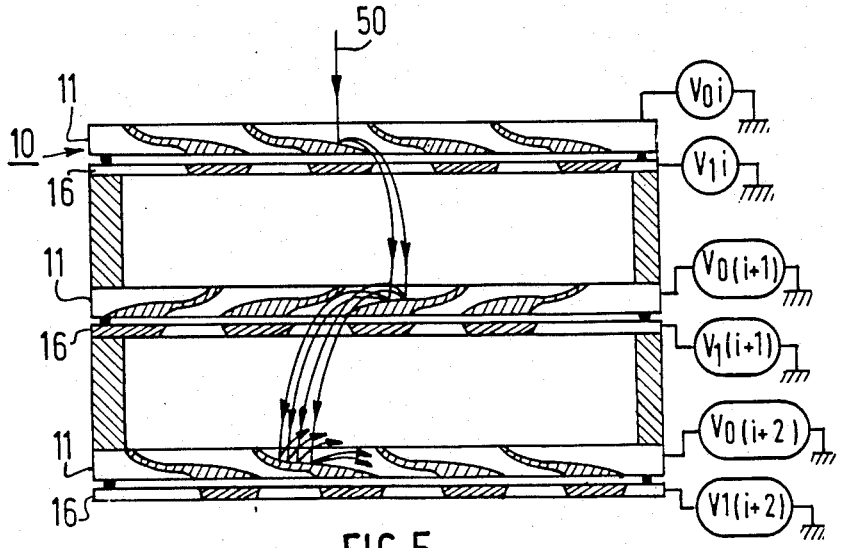
FIG. 5 is a cross-sectional view of a second electron multiplier.

FIGS. 4 and 5 show in a cross-section two electron multipliers comprising N (here N=3) multiplier elements of the type as previously described with reference to FIGS. 1, 2 and 3. The electric potential applied to each of the first and second plates 11 and 16, respectively, of each multiplier element is such that the second metal plate 16 of the (i)th multiplier element is brought to an electric potential $V_{1i}$ which is identical to the electric potential $V0_{(i+1)}$ of the (i+1)st multiplier element. This results in the equations: $V_{1i}=V0_{(i+1)}$ and $V1_{(i+1)}=V0_{(i+2)}$.

The multiplier shown in FIG. 4 has its multiplier elements 10 in a parallel configuration with respect to one another. If maintaining an unequivocal correspondence between the electrons leaving the (i+2)nd multiplier element and the electrons entering the (i)th multiplier element, this configuration leads to a spacial shift between the electrons entering the multiplier and the electrons leaving the multiplier. This shift can be avoided with the multiplier shown in FIG. 5 in the sense that the multiplier elements 10 are consecutively arranged in a head-to-tail configuration with respect to one another.

Figure 6:
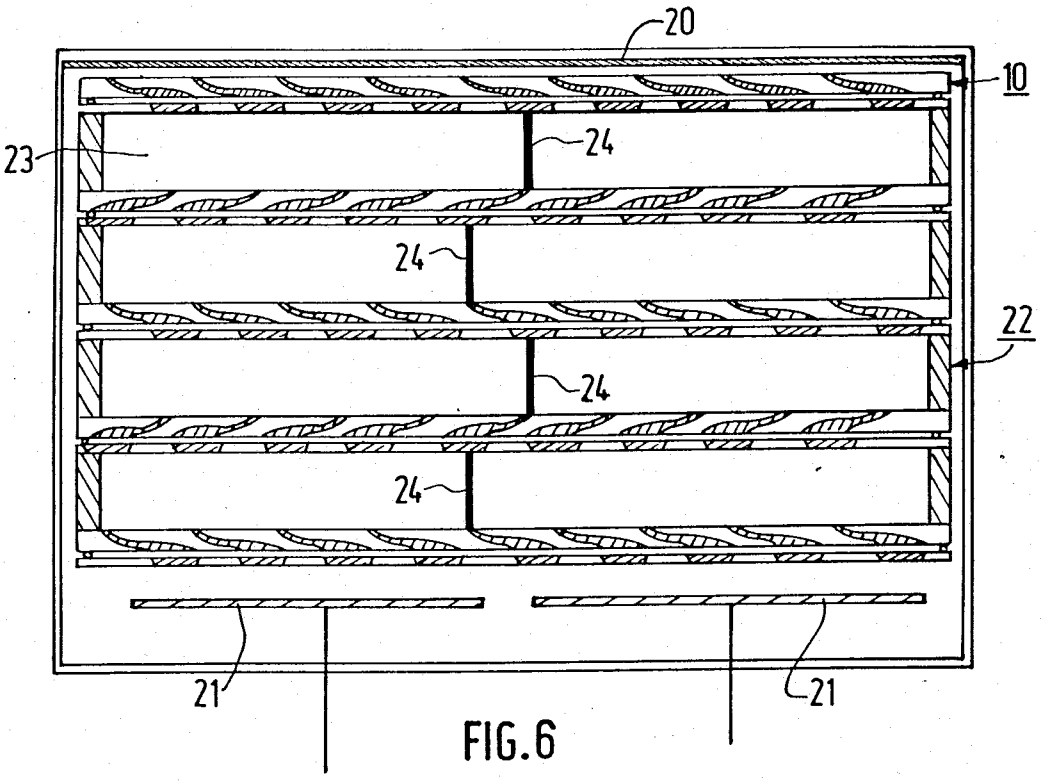
FIG. 6 is a cross-sectional view of a photomultiplier tube comprising a multiplier analogous to that of FIG. 5

The electron multiplier can be particularly used to advantage in the field of photomultiplier tubes, notably in proximity focusing tubes. FIG. 6 shows in a cross-sectional view an example of such an application in a photomultiplier tube comprising a photocathode 20 and n (here n=2) adjacent anodes 21. In conformity with FIG. 6 the multiplier 22 is placed in the proximity of the photocathode 20 and is divided into n secondary multipliers 23 by partitions 24 which are impervious to electrons and are located substantially opposite separation zones of two adjacent anodes 21 in such a manner that n secondary photomultiplier tubes are obtained in one and the same photomultiplier tube. The tubes of the type shown in FIG. 6 can be used advantageously in nuclear physics for the exact localization of detected elementary particles. The impervious partitions 24 are manufactured in a conventional manner by means of masking and photo-etching of a metal plate.

Figure 7A:
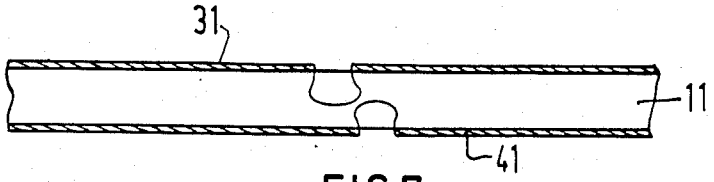
FIG. 7*a*, 7*b*, and 7*c* illustrate by way of cross-sectional views a method of manufacturing a first plate of a multiplier element according to the invention.
Figure 7B:
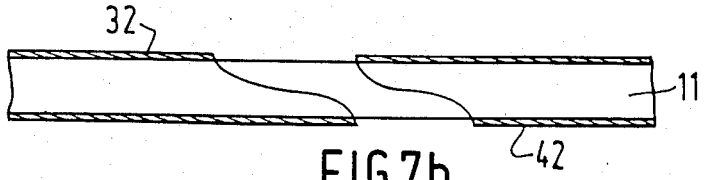
Figure 7C:
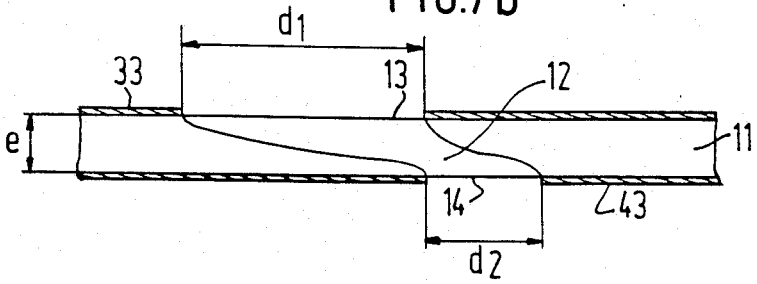

FIG. 7 shows a method of manufacturing a first metal plate 11 of an electron multiplier element of the type described above. In accordance with this method the two faces of the same metal plate 11 are simultaneously etched by means of photo-etching with the aid of a pair of masks 31/41, 32/42 and 33/43 whose successive windows increase in size and are shifted with respect to one another, the windows of the last pair of masks 33/43 reproducing the shapes of the input aperture 13 and the output aperture 14, respectively, of the multiplier hole 12. With this method the Applicant has realized a metal plate having multiplier holes whose thickness was 0.15 mm with dimensions d1, d2 of 0.6 mm and 0.3 mm, respectively, of the apertures.

What is claimed is:

1. An electron multipler element of the apertured plate type for secondary emission, comprising a first metal plate having a plurality of multiplier holes, each said hole having an input aperture, an output aperture, and a wall of emissive power extending therebetween, said input aperture having a cross sectional area that is larger than the cross sectional area of said output aperture, a perpendicular projection of said output aperture onto a plane parallel to said plate being entirely outside the corresponding projection of the input aperture, a second metal plate in parallel with the first plate, said second plate having a like plurality of auxiliary holes, each said auxiliary hole being disposed opposite a respective output aperture, the second plate being brought to an electric potential which is higher than the electric potential of the first plate.

2. A multiplier element as in claim 1 wherein said plurality of multiplier holes is arranged in a rectangular plane network.

3. A multiplier element as claimed in claim 2, characterized in that said regular plane network of multiplier holes is a square-shaped network, and in that said input aperture is square shaped and said output aperture is circular.

4. A multiplier element as claimed in claim 2, characterized in that said regluar plane network of multiplier holes is a hexagonal network and in that said input and output apertures are circular.

5. A multiplier element as claimed in claim 2, characterized in that said regular plane network of multiplier holes is a hexagonal network and in that said input aperture is hexagonal and said output aperture is circular.

6. An electron multiplier comprising N multiplier elements as in claim 1, characterized in that the second metal plate of the (i)th multiplier element is brought to an electric potential which is identical to the electrical potential of the first metal plate of the (i+1)st multiplier element.

7. An electron multiplier as claimed in claim 6, characterized in that said N multiplier elements are arranged in a parallel configuration with respect to one another.

8. An electron multiplier as claimed in claim 6, characterized in that said N multiplier elements are consecutively arranged in a head-to-tail configuration.

9. Application of an electron multiplier as in claim 6 in a photomultiplier tube comprising a photocathode and n adjacent anodes, characterized in that said multiplier is placed in the proximity of the photocathode and is divided into n secondary multipliers by partitions which are impervious to electrons and are located substantially opposite separation zones of the two adjacent anodes in such a manner that n secondary photomultiplier tubes are obtained in one and the same photomultiplier tube.

* * * * *